US006604659B1

(12) United States Patent
Graves

(10) Patent No.: US 6,604,659 B1
(45) Date of Patent: Aug. 12, 2003

(54) FINISHING TOOL HOLDER

(76) Inventor: Matthew L. Graves, 120 W. Terrell St., Greensboro, NC (US) 27420

( * ) Notice: Subject to any disclaimer, the term of this patent is extended or adjusted under 35 U.S.C. 154(b) by 0 days.

(21) Appl. No.: 09/881,876

(22) Filed: Jun. 15, 2001

(51) Int. Cl.[7] ..... A45F 3/00

(52) U.S. Cl. ..... 224/683; 224/232; 224/240; 224/242; 224/904

(58) Field of Search ..... 224/683, 904, 224/581, 582, 583, 270, 240, 242, 269, 232, 245, 233; D3/226, 230, 215

(56) References Cited

U.S. PATENT DOCUMENTS

| | | | | | |
|---|---|---|---|---|---|
| 2,238,324 | A | | 4/1941 | Hopkins | |
| 3,191,825 | A | * | 6/1965 | Beckwith | 224/232 |
| 4,183,439 | A | * | 1/1980 | Bell | 211/70.7 |
| D254,758 | S | * | 4/1980 | Rodstein | 224/904 |
| 4,300,708 | A | | 11/1981 | Pattermann | |
| 4,303,188 | A | | 12/1981 | Calabrese | |
| D271,253 | S | * | 11/1983 | Abatie | 224/673 |
| 4,416,372 | A | | 11/1983 | Polk | |
| D313,121 | S | | 12/1990 | Dise | |
| D316,485 | S | * | 4/1991 | Seber | 224/904 |
| 5,490,607 | A | * | 2/1996 | Hsieh et al. | 206/372 |
| 5,626,272 | A | | 5/1997 | Klemansky | |
| 5,628,443 | A | * | 5/1997 | Deutsch | 150/113 |
| 5,647,130 | A | * | 7/1997 | Collins | 224/232 |
| 5,833,095 | A | * | 11/1998 | Russell et al. | 206/373 |
| 6,119,909 | A | * | 9/2000 | Dancyger | 224/674 |
| 6,357,639 | B1 | * | 3/2002 | Williams | 224/200 |

* cited by examiner

*Primary Examiner*—Stephen P. Garbe
*Assistant Examiner*—Maerena W. Brevard

(57) ABSTRACT

A finishing tool holder includes a plurality of pocket assemblies each having a front wall, a pair of side walls, a rear wall and a bottom wall. The pocket assemblies have a holding space that is adapted for holding a finishing knife. One of the pluralities of pocket assemblies is adapted for removably coupling to the belt of the user. The pocket assemblies are coupled to an adjacent one of the pocket assemblies. A plurality of compartments are provided. Each of the compartments has a storage space adapted for storing one of the finishing knives. Each of the a compartments is coupled to an adjacent one of the compartments. One of the compartments is coupled to one of the pocket assemblies such that the compartments are adapted for being removably coupled to the user.

18 Claims, 4 Drawing Sheets

FINISHING TOOL HOLDER

BACKGROUND OF THE INVENTION

1. Field of the Invention

The present invention relates to tool holders and more particularly pertains to a new finishing tool holder for allowing a user to store finishing tools in an efficient manner such that productivity can be increased.

2. Description of the Prior Art

The use of tool holders is known in the prior art. More specifically, tool holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,626,272; U.S. Pat. No. 4,300,708; U.S. Pat. No. 4,303,188; U.S. Pat. No. 4,416,372; U.S. Pat. No. 2,238,324; and U.S. Pat. No. Des. 313,121.

While these devices fulfill their respective, particular objectives and requirements, the aforementioned patents do not disclose a new finishing tool holder. The inventive device includes a plurality of pocket assemblies each having a front wall, a pair of side walls, a rear wall and a bottom wall. The pocket assemblies have a holding space defined by the front wall, the side walls, the rear wall and the bottom wall such that the holding space is adapted for holding one of the finishing knives. One of the pluralities of pocket assemblies is adapted for removably coupling to the belt of the user. The pocket assemblies are coupled to an adjacent one of the pocket assemblies. A plurality of compartments has a front partition, a pair of end partitions and a bottom partition. Each of the compartments has a storage space defined by the front partition, the end partitions and the bottom partition such that the storage space of each of the compartments is adapted for storing one of the finishing knives. Each of the compartments is coupled to an adjacent one of the compartments. One of the compartments is coupled to one of the pocket assemblies such that the compartments are adapted for being removably coupled to the user.

In these respects, the finishing tool holder according to the present invention substantially departs from the conventional concepts and designs of the prior art, and in so doing provides an apparatus primarily developed for the purpose of for allowing a user to store finishing tools in an efficient manner such that productivity can be increased.

SUMMARY OF THE INVENTION

In view of the foregoing disadvantages inherent in the known types of tool holders now present in the prior art, the present invention provides a new finishing tool holder construction wherein the same can be utilized for allowing a user to store finishing tools in an efficient manner such that productivity can be increased.

The general purpose of the present invention, which will be described subsequently in greater detail, is to provide a new finishing tool holder apparatus and method which has many of the advantages of the tool holders mentioned heretofore and many novel features that result in a new finishing tool holder which is not anticipated, rendered obvious, suggested, or even implied by any of the prior art tool holders, either alone or in any combination thereof.

To attain this, the present invention generally comprises a plurality of pocket assemblies each having a front wall, a pair of side walls, a rear wall and a bottom wall. The pocket assemblies have a holding space defined by the front wall, the side walls, the rear wall and the bottom wall such that the holding space is adapted for holding one of the finishing knives. One of the pluralities of pocket assemblies is adapted for removably coupling to the belt of the user. The pocket assemblies are coupled to an adjacent one of the pocket assemblies. A plurality of compartments has a front partition, a pair of end partitions and a bottom partition. Each of the compartments has a storage space defined by the front partition, the end partitions and the bottom partition such that the storage space of each of the compartments is adapted for storing one of the finishing knives. Each of the compartments is coupled to an adjacent one of the compartments. One of the compartments is coupled to one of the pocket assemblies such that the compartments are adapted for being removably coupled to the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new finishing tool holder apparatus and method which has many of the advantages of the tool holders mentioned heretofore and many novel features that result in a new finishing tool holder which is not anticipated, rendered obvious, suggested, or even implied by any of the prior art tool holders, either alone or in any combination thereof.

It is another object of the present invention to provide a new finishing tool holder, which may be easily and efficiently manufactured and marketed.

It is a further object of the present invention to provide a new finishing tool holder, which is of a durable and reliable construction.

An even further object of the present invention is to provide a new finishing tool holder which is susceptible of a low cost of manufacture with regard to both materials and labor, and which accordingly is then susceptible of low prices of sale to the consuming public, thereby making such finishing tool holder economically available to the buying public.

Still yet another object of the present invention is to provide a new finishing tool holder which provides in the apparatuses and methods of the prior art some of the advantages thereof, while simultaneously overcoming some of the disadvantages normally associated therewith.

Still another object of the present invention is to provide a new finishing tool holder for allowing a user to store finishing tools in an efficient manner such that productivity can be increased.

Yet another object of the present invention is to provide a new finishing tool holder which includes a plurality of pocket assemblies each having a front wall, a pair of side walls, a rear wall and a bottom wall. The pocket assemblies have a holding space defined by the front wall, the side walls, the rear wall and the bottom wall such that the holding space is adapted for holding one of the finishing knives. One of the pluralities of pocket assemblies is adapted for removably coupling to the belt of the user. The pocket assemblies are coupled to an adjacent one of the pocket assemblies. A plurality of compartments has a front partition, a pair of end partitions and a bottom partition. Each of the compartments has a storage space defined by the front partition, the end partitions and the bottom partition such that the storage space of each of the compartments is adapted for storing one of the finishing knives. Each of the compartments is coupled to an adjacent one of the compartments'. One of the compartments is coupled to one of the pocket assemblies such that the compartments are adapted for being removably coupled to the user.

Still yet another object of the present invention is to provide a new finishing tool holder that would be its convenience, accessibility, organization.

Even still another object of the present invention is to provide a new finishing tool holder that could be utilized by professional drywallers as well as do-it-yourselfers. The present invention would give the user a safe place to store finishing knifes while reducing the time a user spends looking for a particular knife.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
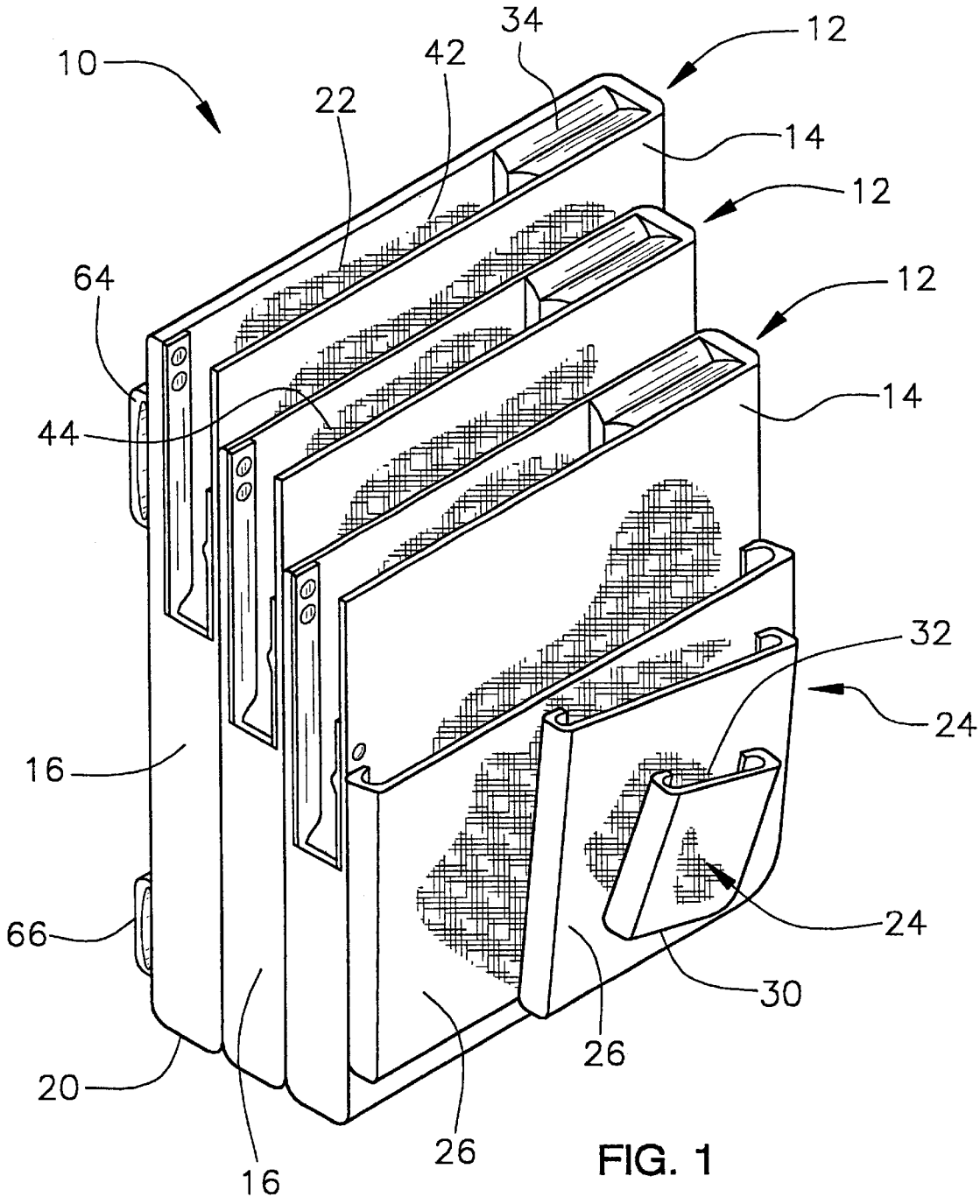
FIG. 1 is a perspective view of a new finishing tool holder according to the present invention.
Figure 2:
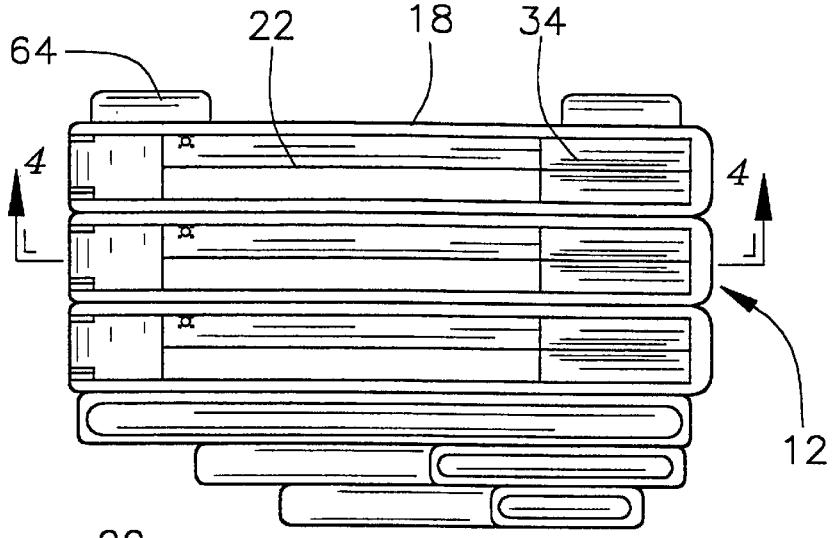
FIG. 2 is a top view of the present invention.
Figure 3:
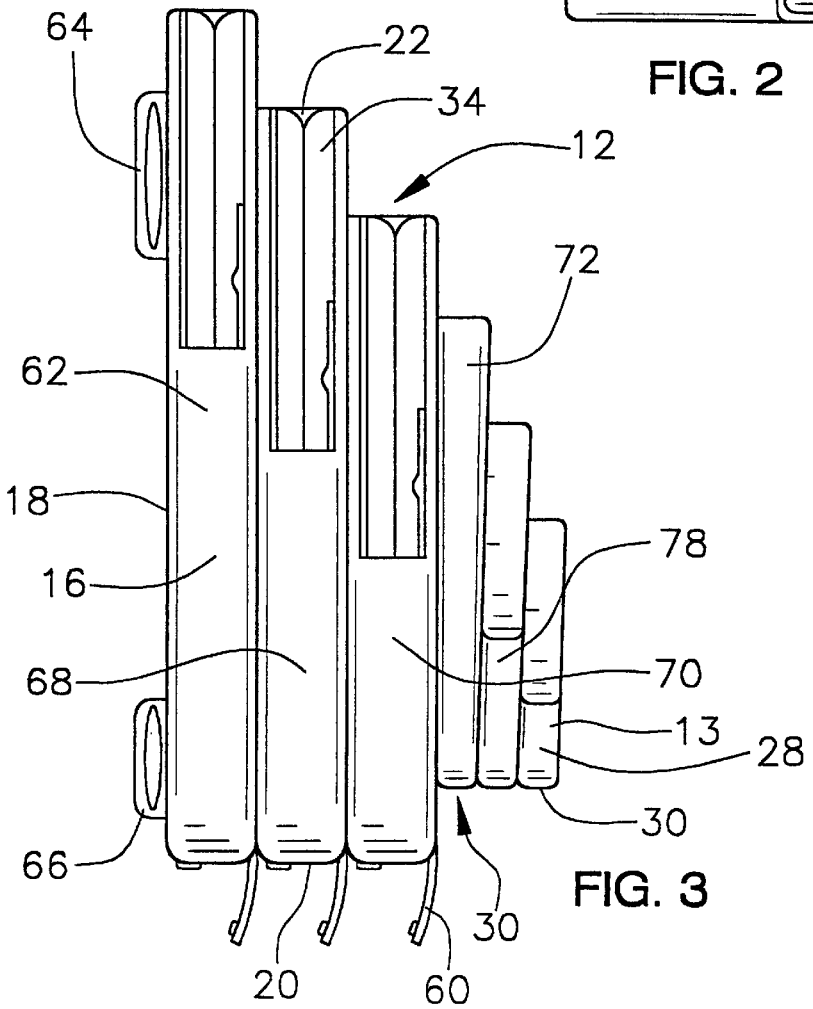
FIG. 3 is a side view of the present invention.
Figure 4:
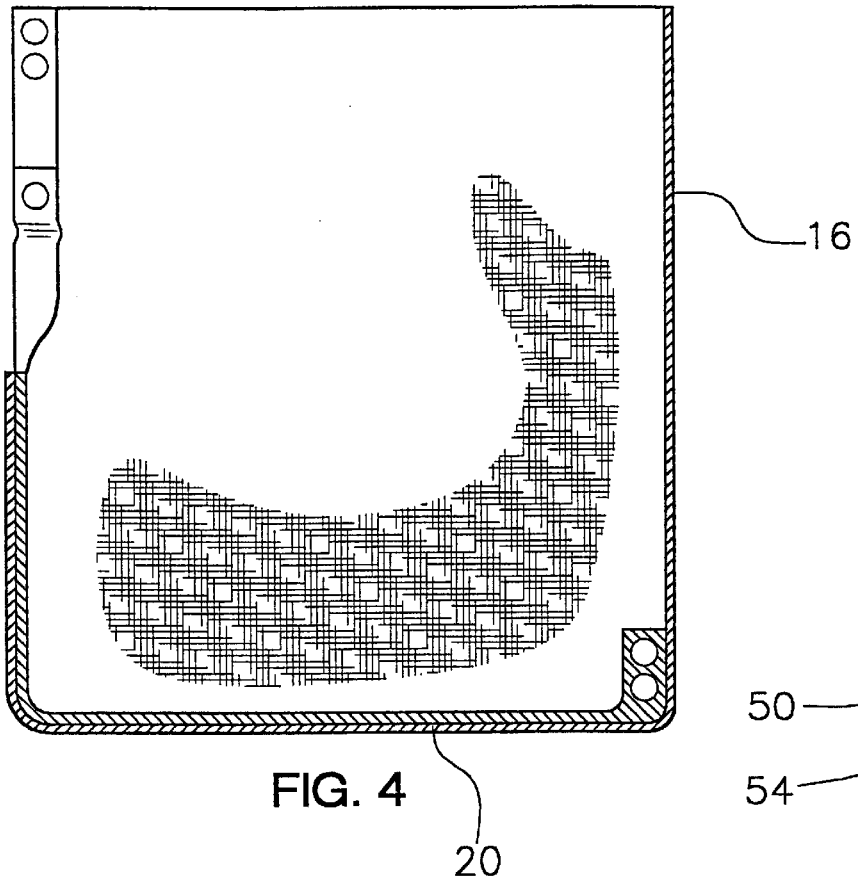
FIG. 4 is a cross-sectional view of the present invention.
Figure 5:
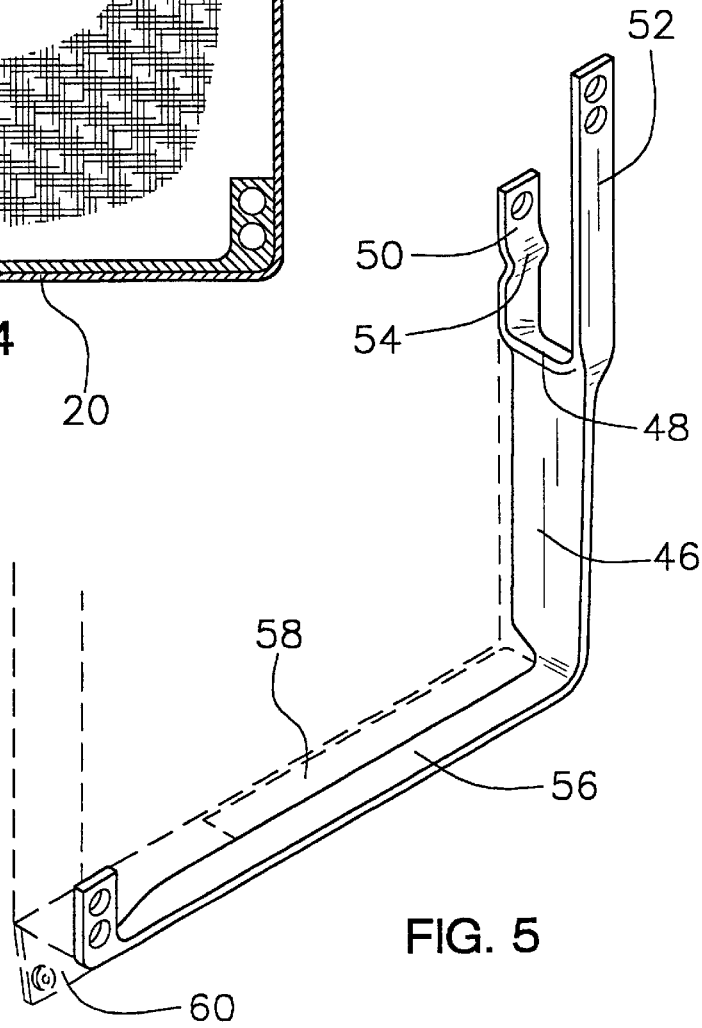
FIG. 5 is a perspective view of the present invention.
Figure 6:
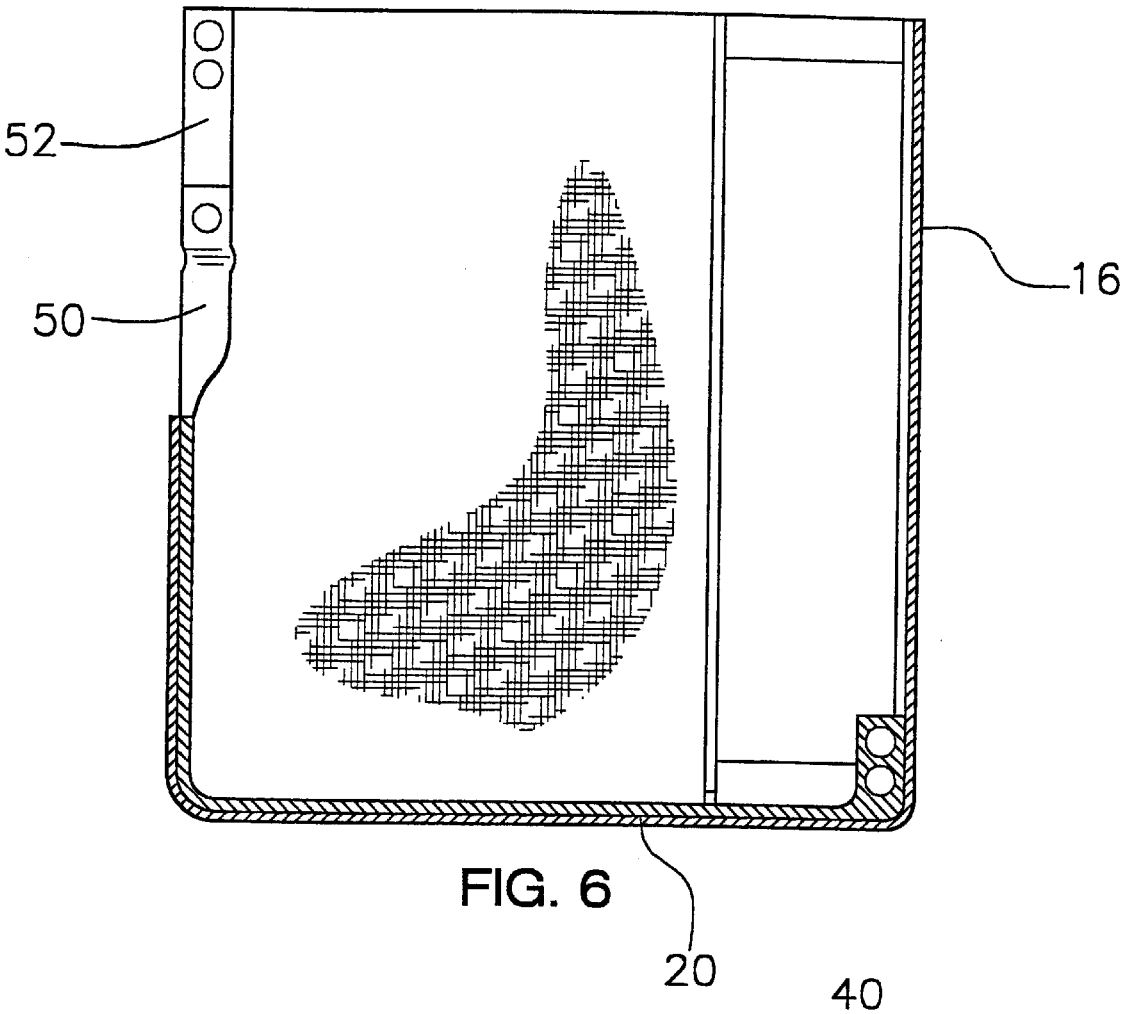
FIG. 6 is a cross-sectional view of the present invention.
Figure 7:
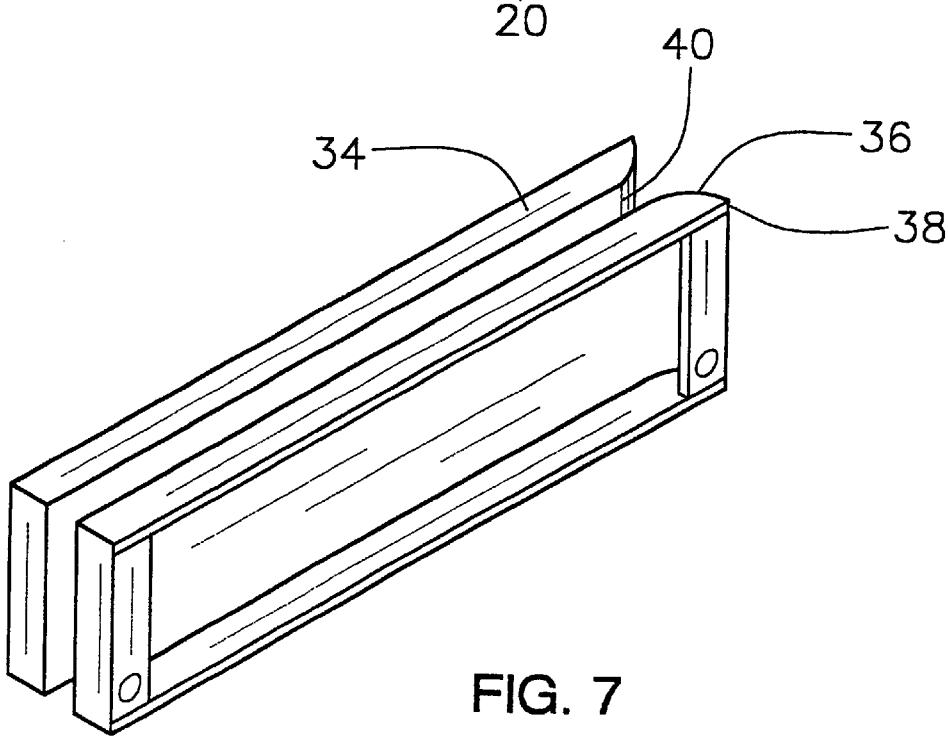
FIG. 7 is a perspective view of the present invention.

With reference now to the drawings, and in particular to FIGS. 1 through 7 thereof, a new finishing tool holder embodying the principles and concepts of the present invention and generally designated by the reference numeral 10 will be described.

As best illustrated in FIGS. 1 through 7, the finishing tool holder 10 generally includes a plurality;of pocket assemblies 12 each has a front wall 14, a pair of side walls 16, a rear wall 18 and a bottom wall 20. The pocket assemblies 12 have a holding space 22 defined by the front wall 14, the side walls 16, the rear wall 18 and the bottom wall 20 such that the holding space 22 is adapted for holding one of the finishing knives. One of the pluralities of pocket assemblies 12 is adapted for removably coupling to the belt of the user. The pocket assemblies 12 are coupled to an adjacent one of the pocket assemblies 12. A plurality of compartments 24 has a front partition 26, a pair of end partitions 28 and a bottom partition 30. Each of the compartments 24 has a storage space 32 defined by the front partition 26, the end partitions 28 and the bottom partition 30 such that the storage space 32 of each of the compartments 24 is adapted for storing one of the finishing knives. Each of the compartments 24 is coupled to an adjacent one of the compartments 24. One of the compartments 24 is coupled to one of the pocket assemblies 12 such that the compartments 24 are adapted for being removably coupled to the user.

Each of the pocket assemblies 12 has a pair of blade retention members 34 coupled between the rear wall 18 and the front wall 14. The blade retention members 34 are adapted for supporting a blade of one of the finishing knives between the blade retention members 34. Each of the blade retention members 34 includes an arcuate upper face 36. The arcuate upper face 36 of each of the blade retention members 34 concavely extend from an outer edge 38 to an inner edge 40 of the arcuate upper face 36 such that the arcuate upper face 36 is adapted for guiding the blade of the finishing knife between the blade retention members 34. The blade retention members 34 include a friction enhancing material. The friction enhancing material is adapted for preventing the associated finishing knife from inadvertently slipping out of associated the pocket assemblies.

The side walls 16 of each of the pocket assemblies 12 has a slot 42 that has an open upper end 44 and extending a portion of a length of respective side walls 16. The slot 42 of each of the pocket assemblies 12 is adapted for permitting a handle of one of the finishing knives to extend away from the holding space 22 of respective pocket assemblies 12.

A bracket 46 is coupled within the holding space 22 of each of the pocket assemblies 12 proximate the slot 42 in one of the side walls 16. The bracket 46 has a yoke portion 48, a first arm 50 of the yoke portion 48 is positioned adjacent the front wall 14. A second arm 52 of the yoke portion 48 is positioned adjacent the rear wall 18. The yoke portion 48 is adapted for receiving the handle of one of the finishing knives between the first arm 50 and the second arm 52. The first arm 50 of the yoke portion 48 of the bracket 46 has a retaining nub 54 that extends from the first arm 50 towards the second arm 52. The handle of one of the finishing knives is permitted to pass between the retaining nub 54 and the second arm 52 and becoming retained between the first arm 50 and the second arm 52 below the retaining nub 54. The retaining nub 54 is adapted for preventing the handle of the finishing knife from becoming dislodged from the yoke 48. The bracket 46 has bottom arm 56 that is positioned adjacent the bottom wall 20 of the respective pocket assembly 12. The bottom arm 56 has a width less than a width of the bottom wall 20. A cleaning aperture 58 extends through the bottom wall 20 of each of the pocket assemblies 12 such that the cleaning aperture 58 is adapted for permitting cleaning of debris from the holding space 22 through the cleaning aperture 58.

The pocket assemblies 12 have a flap 60 that is coupled to the bottom wall 20. The flap 60 is for extending across the bottom wall 20 for covering the cleaning aperture 58 through the bottom wall 20, the flap 60 is removably couplable to the bottom wall 20. The plurality of the pocket assemblies 12 includes a first pocket assembly 62. A pair of belt loops 64 is coupled to the rear wall 18 of the first pocket assembly 62 such that the pair of belt loops 64 are adapted for removably receiving the belt of the user through the belt loops 64. A pair of thigh strap loops 66 is coupled to a rear wall 18 of the first pocket assembly 62. The thigh strap loops 66 is adapted for removably receiving a strap securing the first pocket assembly 62 to a thigh of the user. The plurality of pocket assemblies 12 includes a second pocket assembly 68. The rear wall 18 of the second pocket assembly 68 is coupled to the front wall 14 of the first pocket assembly 62. The second pocket assembly 68 has a height less than a height of the first pocket assembly 62 such that the second pocket assembly 68 is adapted for holding one of the finishing knives smaller than one of the finishing knives held by the first pocket assembly 62. The plurality of pocket assemblies 12 includes a third pocket assembly 70. The rear wall 18 of the third pocket assembly 70 is coupled to the front wall 14 of the second pocket assembly 68. The third pocket assembly 70 has a height less than the height of the second pocket.assembly 68 such that the third pocket assembly 70 is adapted for holding one of the finishing knives smaller than one of the finishing knives held by the second pocket assembly 68.

The plurality of compartments includes a first compartment 72. The end partitions 74 and the bottom partition 30 of the first compartment 72 is coupled to the front wall 14 of the third pocket assembly 70. The first compartment 72 has a height less than the height of the third pocket assembly 70 such that the first compartment 72 is adapted for holding one of the finishing knives smaller than one of the finishing knives held by the third pocket assembly 70. The plurality of compartments includes a second compartment 78. The end partitions 74 and the bottom partition 30 of the second compartment 78 is coupled to the front partition 11 of the first compartment 72. The second compartment 78 has a height less than the height of the first compartment 72 such that the second compartment 78 is adapted for holding one of the finishing knives smaller than one of the finishing knives held by the first compartment 72. The plurality of compartments includes a third compartment 13. The end partitions 74 and the bottom partition 30 of the third compartment 13 is coupled to the front partition 11 of the second compartment 78. The third compartment 13 has a height less than the height of the second compartment 78 such that the third compartment 13 is adapted for holding one of the finishing knives smaller than one of the finishing knives held by the second compartment 78.

In use, a user would secure the present invention to the belt of a user. The present invention would organize multiple finishing knifes in a series of six different sized pockets would be incorporated into the design of this pouch. The design would create a system of organization that would be helpful when a worker was reaching for a particular sized knife.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A finishing tool holder for holding varying sizes of finishing knives from a belt of a user, the finishing tool holder comprising:

a plurality of pocket assemblies each having a front wall, a pair of side walls, a rear wall and a bottom wall, each of said pocket assemblies having a holding space defined by said front wall, said side walls, said rear wall and said bottom wall such that said holding space is adapted for holding one of the finishing knives, one of said plurality of pocket assemblies being adapted for removably coupling to the belt of the user, each of said pocket assemblies being coupled to an adjacent one of said pocket assemblies;

a plurality of compartments having a front partition, a pair of end partitions and a bottom partition, each of said compartments having a storage space defined by said front partition, said end partitions and said bottom partition such that said storage space of each of said compartments is adapted for storing one of the finishing knives, each of said compartments being coupled to an adjacent one of said compartments, one of said compartments being coupled to one of said pocket assemblies such that said compartments are adapted for being removably coupled to the user; and each of said pocket assemblies having a pair of blade retention members coupled between said rear wall and said front wall, said blade retention members being adapted for supporting a blade of one of the finishing knives between said blade retention members.

2. The finishing tool holder as set forth in claim 1, wherein each of said blade retention members comprises an arcuate upper face, said arcuate upper face of each of said blade retention members concavely extending from an outer edge to an inner edge of said arcuate upper face such that said arcuate upper face is adapted for guiding the blade of the finishing knife between said blade retention members.

3. The finishing tool holder as set forth in claim 1, wherein each of said blade retention members comprises a friction enhancing material, said friction enhancing material being adapted for preventing the associated finishing knife from inadvertently slipping out of associated said pocket assemblies.

4. The finishing tool holder as set forth in claim 1, wherein one of said side walls of each of said pocket assemblies has a slot having an open upper end and extending a portion of a length of respective side walls, said slot of each of said pocket assemblies being adapted for permitting a handle of one of the finishing knives to extending away from said holding space of respective pocket assemblies.

5. The finishing tool holder as set forth in claim 4, further comprises:

a bracket being coupled within said holding space of each of said pocket assemblies proximate said slot in one of said side walls, said bracket having an yoke portion, a first arm of said yoke portion being positioned adjacent said front wall, a second arm of said yoke portion being positioned adjacent said rear wall, said yoke portion being adapted for receiving the handle of one of the finishing knives between said first arm and said second arm.

6. The finishing tool holder as set forth in claim 5, wherein said first arm of said yoke portion of said bracket has a retaining nub extending from said first arm towards said second arm such that the handle of one of the finishing knives is permitted to pass between said retaining nub and said second arm and becoming retained between said first arm and said second arm below said retaining nub whereby said retaining nub is adapted for preventing the handle of the finishing knife from becoming dislodged from said yoke.

7. The finishing tool holder as set forth in claim 5, wherein said bracket has bottom arm being positioned adjacent said bottom wall of said respective pocket assembly, said bottom arm having a width less than a width of said bottom wall, a cleaning aperture extending through said bottom wall of each of said pocket assemblies such that said cleaning aperture is adapted for permitting cleaning of debris from said holding space through said cleaning aperture.

8. The finishing tool holder as set forth in claim 7, wherein each of said pocket assemblies has a flap being coupled to said bottom wall, said flap being for extending across said bottom wall for covering said cleaning aperture through said bottom wall, said flap being removably couplable to said bottom wall.

9. The finishing tool holder as set forth in claim 1, wherein said plurality of said pocket assemblies includes a first pocket assembly, a pair of belt loops being coupled to said rear wall of said first pocket assembly such that said pair of belt loops are adapted for removably receiving the belt of the user through said belt loops.

10.The finishing tool holder as set forth in claim 9, further comprising:

a pair of thigh strap loops being coupled to a rear wall of said first pocket assembly, said thigh strap loops being adapted for removably receiving a strap securing said first pocket assembly to a thigh of the user.

11. The finishing tool holder as set forth in claim 9, wherein said plurality of pocket assemblies includes a second pocket assembly, said rear wall of said second pocket assembly being coupled to said front wall of said first pocket assembly, said second pocket assembly having a height less than a height of said first pocket assembly such that said second pocket assembly is adapted for holding one of the finishing knives smaller than one of the finishing knives held by said first pocket assembly.

12. The finishing tool holder as set forth in claim 11, wherein said plurality of pocket assemblies includes a third pocket assembly, said rear wall of said third pocket assembly being coupled to said front wall of said second pocket assembly, said third pocket assembly having a height less than said height of said second pocket assembly such that said third pocket assembly is adapted for holding one of the finishing knives smaller than one of the finishing knives held by said second pocket assembly.

13. The finishing tool holder as set forth in claim 12, wherein said plurality of compartments includes a first compartment, said side partitions and said bottom partition of said first compartment being coupled to said front wall of said third pocket assembly, said first compartment having a height less than said height of said third pocket assembly such that said first compartment is adapted for holding one of the finishing knives smaller than one of the finishing knives held by said third pocket assembly.

14. The finishing tool holder as set forth in claim 13, wherein said plurality of compartments includes a second compartment, said side partitions and said bottom partition of said second compartment being coupled to said front partition of said first compartment, said second compartment having a height less than said height of said first compartment such that said second compartment is adapted for holding one of the finishing knives smaller than one of the finishing knives held by said first compartment.

15. The finishing tool holder as set forth in claim 14, wherein said plurality of compartments includes a third compartment, said side partitions and said bottom partition of said third compartment being coupled to said front partition of said second compartment, said third compartment having a height less than said height of said second compartment such that said third compartment is adapted for holding one of the finishing knives smaller than one of the finishing knives held by said second compartment.

16. The finishing tool holder as set forth in claim 1, further comprising:

wherein each of said blade retention members comprises an arcuate upper face, said arcuate upper face of each of said blade retention members concavely extending from an outer edge to an inner edge of said arcuate upper face such that said arcuate upper face is adapted for guiding the blade of the finishing knife between said blade retention members;

wherein each of said blade retention members comprises a friction enhancing material, said friction enhancing material being adapted for preventing the associated finishing knife from inadvertently slipping out of associated said pocket assemblies;

wherein one of said side walls of each of said pocket assemblies has a slot having an open upper end and extending a portion of a length of respective side walls, said slot of each of said pocket assemblies being adapted for permitting a handle of one of the finishing knives to extending away from said holding space of respective pocket assemblies;

wherein a bracket being coupled within said holding space of each of said pocket assemblies proximate said slot in one of said side walls, said bracket having an yoke portion, a first arm of said yoke portion being positioned adjacent said front wall, a second arm of said yoke portion being positioned adjacent said rear wall, said yoke portion being adapted for receiving the handle of one of the finishing knives between said first arm and said second arm;

wherein said first arm of said yoke portion of said bracket has a retaining nub extending from said first arm towards said second arm such that the handle of one of the finishing knives is permitted to pass between said retaining nub and said second arm and becoming retained between said first arm and said second arm below said retaining nub whereby said retaining nub is adapted for preventing the handle of the finishing knife from becoming dislodged from said yoke;

wherein said bracket has bottom arm being positioned adjacent said bottom wall of said respective pocket assembly, said bottom arm having a width less than a width of said bottom wall, a cleaning aperture extending through said bottom wall of each of said pocket assemblies such that said cleaning aperture is adapted for permitting cleaning of debris from said holding space through said cleaning aperture;

wherein each of said pocket assemblies has a flap being coupled to said bottom wall, said flap being for extending across said bottom wall for covering said cleaning aperture through said bottom wall, said flap being removably couplable to said bottom wall;

wherein said plurality of said pocket assemblies includes a first pocket assembly, a pair of belt loops being coupled to said rear wall of said first pocket assembly such that said pair of belt loops are adapted for removably receiving the belt of the user through said belt loops;

wherein a pair of thigh strap loops being coupled to a rear wall of said first pocket assembly, said thigh strap loops being adapted for removably receiving a strap securing said first pocket assembly to a thigh of the user;

wherein said plurality of pocket assemblies includes a second pocket assembly, said rear wall of said second pocket assembly being coupled to said front wall of said first pocket assembly, said second pocket assembly having a height less than a height of said first pocket assembly such that said second pocket assembly is adapted for holding one of the finishing knives smaller than one of the finishing knives held by said first pocket assembly;

wherein said plurality of pocket assemblies includes a third pocket assembly, said rear wall of said third pocket assembly being coupled to said front wall of said second pocket assembly, said third pocket assembly having a height less than said height of said second pocket assembly such that said third pocket assembly is adapted for holding one of the finishing knives smaller than one of the finishing knives held by said second pocket assembly;

wherein said plurality of compartments includes a first compartment, said side partitions and said bottom partition of said first compartment being coupled to said front wall of said third pocket assembly, said first compartment having a height less than said height of said third pocket assembly such that said first compartment is adapted for holding one of the finishing knives smaller than one of the finishing knives held by said third pocket assembly;

wherein said plurality of compartments includes a second compartment, said side partitions and said bottom partition of said second compartment being coupled to said front partition of said first compartment, said second compartment having a height less than said height of said first compartment such that said second compartment is adapted for holding one of the finishing knives smaller than one of the finishing knives held by said first compartment;

wherein said plurality of compartments includes a third compartment, said side partitions and said bottom partition of said third compartment being coupled to said front partition of said second compartment, said third compartment having a height less than said height of said second compartment such that said third compartment is adapted for holding one of the finishing knives smaller than one of the finishing knives held by said second compartment.

17. A finishing tool holder for holding varying sizes of finishing knives from a belt of a user, the finishing tool holder comprising:

a plurality of pocket assemblies each having a front wall, a pair of side walls, a rear wall and a bottom wall, each of said pocket assemblies having a holding space defined by said front wall, said side walls, said rear wall and said bottom wall such that said holding space is adapted for holding one of the finishing knives, one of said plurality of pocket assemblies being adapted for removably coupling to the belt of the user, each of said pocket assemblies being coupled to an adjacent one of said pocket assemblies;

a plurality of compartments having a front partition, a pair of end partitions and a bottom partition, each of said compartments having a storage space defined by said front partition, said end partitions and said bottom partition such that said storage space of each of said compartments is adapted for storing one of the finishing knives, each of said compartments being coupled to an adjacent one of said compartments, one of said compartments being coupled to one of said pocket assemblies such that said compartments are adapted for being removably coupled to the user; and one of said side walls of each of said pocket assemblies has a slot having an open upper end and extending a portion of a length of respective side walls, said slot of each of said pocket assemblies being adapted for permitting a handle of one of the finishing knives to extending away from said holding space of respective pocket assemblies.

18. A finishing tool holder for holding varying sizes of finishing knives from a belt of a user, the finishing tool holder comprising:

a plurality of pocket assemblies each having a front wall, a pair of side walls, a rear wall and a bottom wall, each of said pocket assemblies having a holding space defined by said front wall, said side walls, said rear wall and said bottom wall such that said holding space is adapted for holding one of the finishing knives, one of said plurality of pocket assemblies being adapted for removably coupling to the belt of the user, each of said pocket assemblies being coupled to an adjacent one of said pocket assemblies;

a plurality of compartments having a front partition, a pair of end partitions and a bottom partition, each of said compartments having a storage space defined by said front partition, said end partitions and said bottom partition such that said storage space of each of said compartments is adapted for storing one of the finishing knives, each of said compartments being coupled to an adjacent one of said compartments, one of said compartments being coupled to one of said pocket assemblies such that said compartments are adapted for being removably coupled to the user;

said plurality of said pocket assemblies includes a first pocket assembly, a pair of belt loops being coupled to said rear wall of said first pocket assembly such that said pair of belt loops are adapted for removably receiving the belt of the user through said belt loops; and a pair of thigh strap loops being coupled to a rear wall of said first pocket assembly, said thigh strap loops being adapted for removably receiving a strap securing said first pocket assembly to a thigh of the user.

* * * * *